US006006048A

United States Patent [19]

Folkins

[11] Patent Number: 6,006,048

[45] Date of Patent: Dec. 21, 1999

[54] WRONG-SIGN TONER DETECTION SYSTEM

[75] Inventor: Jeffrey J. Folkins, Rochester, N.Y.

[73] Assignee: Xerox Corporation, Stamford, Conn.

[21] Appl. No.: 09/165,381

[22] Filed: Oct. 2, 1998

[51] Int. Cl.[6] ..... G03G 15/06

[52] U.S. Cl. ..... 399/55; 399/29

[58] Field of Search ..... 399/24, 27, 29, 399/30, 53, 55, 253, 257, 282, 285, 290, 343, 349

[56] References Cited

U.S. PATENT DOCUMENTS

| | | | |
|---|---|---|---|
| 3,865,080 | 2/1975 | Hudson | 399/253 |
| 4,387,982 | 6/1983 | Stanley | 399/285 X |
| 5,063,875 | 11/1991 | Folkins et al. . | |
| 5,162,874 | 11/1992 | Butler | 356/446 |
| 5,236,795 | 8/1993 | Berman et al. | 399/29 X |
| 5,337,124 | 8/1994 | Schmidlin et al. | 399/282 |
| 5,512,981 | 4/1996 | Hirsch | 399/257 X |
| 5,579,089 | 11/1996 | Folkins . | |
| 5,655,204 | 8/1997 | Siegel | 399/349 |

*Primary Examiner*—Sandra Brase
*Attorney, Agent, or Firm*—Lloyd F. Beali

[57] ABSTRACT

An electrophotographic reproduction machine including an image bearing member, latent image devices for forming on the image bearing member electrostatic latent images having a first relative polarity, and a hybrid development unit for applying to the latent images correct-sign toner particles having a second polarity relatively opposite to the first polarity. A detecting apparatus adjacent the image bearing member for sensing toner particles developed into non-image regions. The development unit includes a first biasing means including a DC power supply for biasing a magnetic roll mounted within the housing of the hybrid development unit. A second biasing means includes a second DC power for biasing a donor roll mounted which forms a toner transfer nip with the magnetic roll. The DC power supplies is adjusted so that "wrong sign" toner of said first polarity are attracted to the donor roll from the magnetic brush within the housing of the hybrid development unit. An electrostatic field is produced between the image bearing member and the donor roll having a wrong-sign toner thereon. The wrong sign toner is attracted to the image bearing member; and a sensor senses wrong-sign toner on said image bearing member.

2 Claims, 2 Drawing Sheets

WRONG-SIGN TONER DETECTION SYSTEM

BACKGROUND OF THE INVENTION

This invention relates to electrostatographic reproduction machines, and more particularly to a hybrid development type electrostatographic reproduction machine having a system to detect a wrong-sign or wrong-polarity toner in a developer unit. Generally, the process of electrostatographic copying is executed by first using a corona generating or charging device to uniformly charge a photoreceptive member to a first polarity, and then exposing a light image of an original document, positioned in registration on a platen, onto the charged photoreceptive member. Exposing the charged photoreceptive member to a light image selectively discharges the photoconductive surface thereof in areas corresponding, for example, to non-image areas in the original document, while maintaining the charge (of the first polarity) on the image areas, thus creating an electrostatic latent image of the first polarity on the photoreceptive member.

The undischarged areas comprising the electrostatic latent image are subsequently developed with correct-sign or correct-polarity charged toner particles into a visible toner image. The sign or polarity of such correct-sign or correct-polarity toner, as is well known, is relatively opposite the first polarity of the latent image being developed. Ordinarily, toner particles are contained in the sump of a development apparatus where they are moved and mixed with carrier particles in order to triboelectrically charge the toner to the correct polarity. The toner image is thereafter transferred from the photoreceptive member onto a clean copy sheet on which the image is then fused or permanently affixed in order to provide a hard copy reproduction of the original document.

Unfortunately, the quality of the development step and that of the hard copy reproduction can be detrimentally affected by the effects of wrong-sign or wrong-polarity toner which forms and accumulates inside the sump of the development apparatus. Wrong-sign toner in the development sump of an electrostatographic reproduction machine is ordinarily the source of many machine performance failure modes, some of which can have catastrophic effects.

Wrong-sign toner is associated with a problem with excessive development of these wrong-sign toner particles in the background or non-image areas. This background development can be quite visible on the final copy sheet and is therefore a quite objectionable defect. The donor or developer roll which has predominantly correct sign charged toner on it might under certain conditions contain a small amount of oppositely charged carrier particles. The toner particles on this roll contact or develop both image and background areas on the photoreceptor of the machine. During such contact, wrong-sign toner particles on the donor or developer roll see each background area of the photoreceptor as a "development field" to which to transfer. This is because background areas are biased to repel correct-sign toner thus acting as a background cleaning field for toner of the correct sign or polarity. As such wrong-sign toner particles which have a polarity opposite to that of the correct-sign toner particles, obviously become attracted to these background areas, and so are transferred thus from and out of the developer housing.

It is therefore an object of the present invention to provide a method to detect detrimental amount of wrong-sign toner in development housings so to enable a process system to enter a correction mode to adjust for wrong signed toner. The correction mode could include lowering toner concentration; admixed cycle or entering in a purging mode.

The present invention utilizes a "hybrid" style development system, see for example Development Apparatus Having a Transport Roll Rotating at Least Twice the Surface Velocity of a Donor Roll", Jeffrey J. Folnins and Joseph Schram, D/89016, U.S. Pat. No. 5,063,875. In such a Hybrid system a magnetic brush dual component toner delivery system toner is applied to a "donor" or development roller according to the voltage difference between the DC bias on the donor and the loading "magnetic" roller. During normal operation the polarity and amplitude of the donor to magnetic roller bias difference is adjusted so that right signed toners on the magnetic roller are attracted and developed onto the surface of the donor roll from where they are transported into the region adjacent to the PR where they are then given the opportunity to develop any electrostatic latent images which might be present on the PR. During standby or non-imaging periods the donor to magnetic voltage difference is sometimes reversed to cause any toner on the donor roll to return back to the magnetic roller and be refreshed triboelectrically.

SUMMARY OF THE INVENTION

There is provided an electrophotographic reproduction machine including an image bearing member, latent image devices for forming on the image bearing member electrostatic latent images having a first relative polarity, and a hybrid development unit for applying to the latent images correct-sign toner particles having a second polarity relatively opposite to the first polarity. A detecting apparatus adjacent the image bearing member for sensing toner particles developed into non-image regions. The development unit includes a first biasing means including a DC power supply for biasing a magnetic roll mounted within the housing of the hybrid development unit. A second biasing means includes a second DC power for biasing a donor roll mounted which forms a toner transfer nip with the magnetic roll The DC power supplies is adjusted so that "wrong sign" toner of said first polarity are attracted to the donor roll from the magnetic brush within the housing of the hybrid development unit. An electrostatic field is produced between the image bearing member and the donor roll having a wrong-sign toner thereon. The wrong sign toner is attracted to the image bearing member; and the sensor senses wrong-sign toner on said image bearing member.

There is also provided a method for detecting wrong-sign toner in a development system having a donor member mounted a housing having charge toner therein, including the steps of: transferring wrong toner in the housing to the donor member; generating an electrostatic field between an image bearing member and the donor member to attract wrong sign toner to the image bearing member; and sensing wrong sign toner on the image bearing member.

DESCRIPTION OF THE DRAWINGS

In the detailed description of the invention presented below, reference is made to the drawings, in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defamed by the appended claims.

Figure 1:
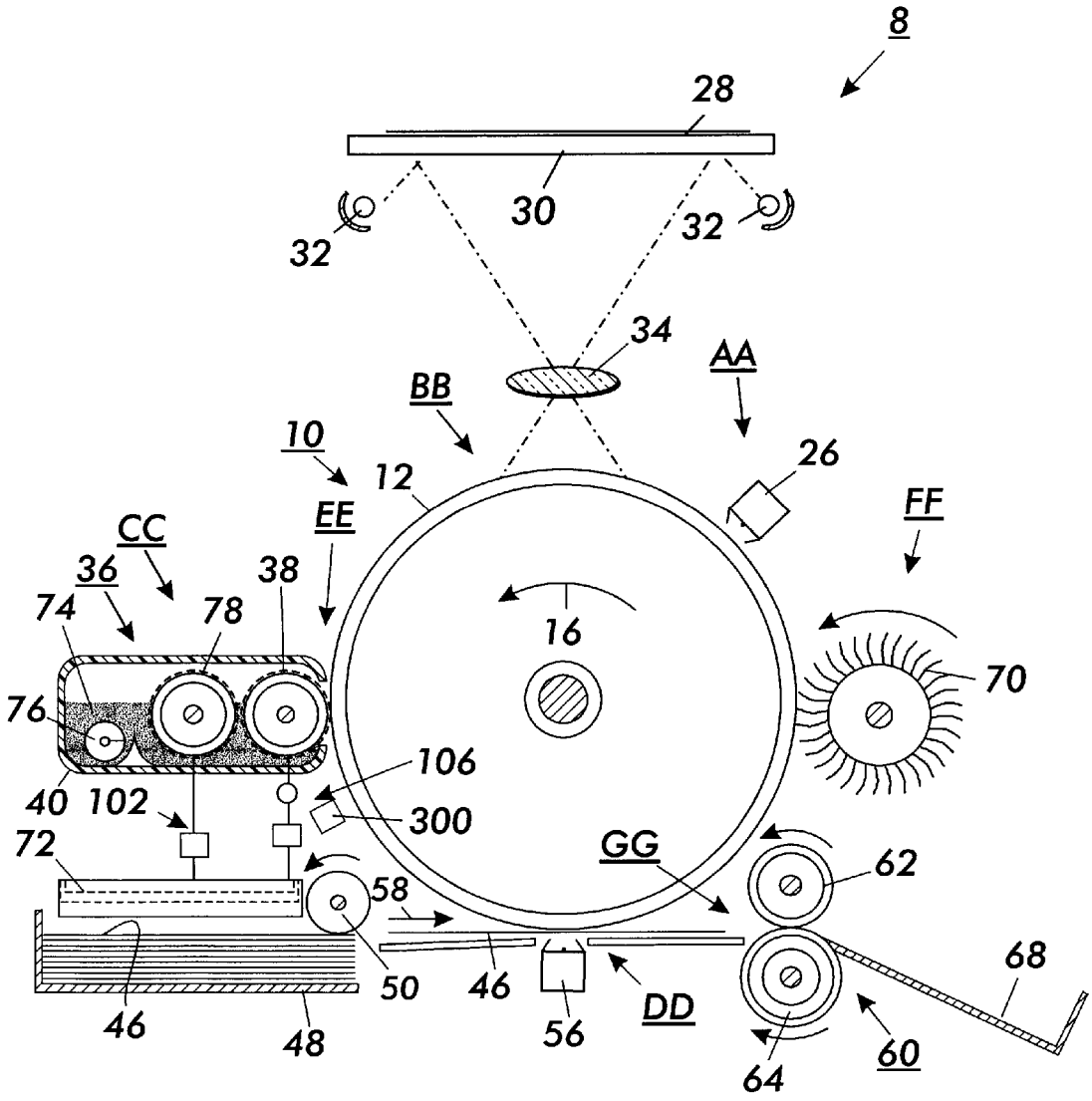
FIG. 1 is a schematic view showing an exemplary electrophotographic reproduction machine including a hybrid development system and the wrong sign toner purging apparatus of the present invention.

Referring initially to FIG. 1, an exemplary electrostatographic reproduction machine 8 incorporating a hybrid development apparatus is illustrated. The exemplary electrophotographic machine 8, for example, employs a photoreceptive member 10 shown as a drum 10 including a photoconductive surface 12. As is well known, the photoconductive member can equally be a suitably mounted belt having a photoconductive surface. The photoconductive drum 10 is coupled to a motor (not shown) for rotation about a process path in the direction of arrow 16 for advancing successive portions of photoconductive surface 12 through various processing stations disposed about the process path. Initially, a surface portion of drum 10 passes through a charging station AA.

At charging station AA, a corona generating device 26 for producing charges of a given first polarity charges photoconductive surface 12 to a relatively high and substantially uniform potential of the given first polarity.

Once charged, photoconductive surface 12 is advanced to an imaging station BB where an original document 28, positioned face down and in accordance with a fixed registration mark or position on a transparent platen 30, is exposed to light from light sources, such as lamps 32. Light rays from the lamps 32 are reflected imagewise from the document 28 thus forming a light image of the original document 28. The reflected rays are transmitted through a lens 34 and focused onto a portion of the charged photoconductive surface 12, selectively dissipating the uniform charge on impacted areas thereof. As such, an electrostatic latent image corresponding to the original document 28 is recorded onto photoconductive surface 12, for example, as the undischarged, first polarity areas of the portion of the surface 12. The discharged areas of the particular portion are therefore the background areas to this latent image.

Although an optical system has been shown and described for forming the light image used to selectively discharge the charged photoconductive surface 12, one skilled in the art will appreciate that a properly modulated scanning beam of energy (e.g., a laser beam) may equally be used to imagewise irradiate the charged portion of the photoconductive surface 12 in order to record the latent image thereon.

After the electrostatic latent image is recorded on photoconductive surface 12, drum 10 advances to development station CC where the hybrid development apparatus 36 (to be described in detail below) transfers "correct charged" toner particles having a polarity that is opposite and thus attractive to the image areas of the electrostatic latent image relative to the development apparatus bias potential. Development apparatus 36, for example, may include a single developer roller 38 disposed in a developer housing 40. As shown, the hybrid development apparatus 36 includes a donor roller 38 that rotates, bringing the correct polarity charged toner particles into a development zone or nip formed with photoconductive surface 12, thus developing the latent image on the surface 12 into a visible toner image.

After development of the electrostatic latent image as such, drum 10 advances the toner image to transfer station DD. At transfer station DD, a sheet of support material 46 is moved into contact with the toner image by means of a sheet feeding apparatus 48. Preferably, sheet feeding apparatus 48 includes a feed roller 50 which rotates while in contact with a stack of sheets to advance the uppermost sheet. The advancing sheet of support material 46 is moved into contact with photoconductive surface 12 of drum 10 at transfer station DD in a timed sequence so that the developed image on the surface 12 contacts the advancing sheet of support material 46, and is transferred.

A transfer corotron 56 is provided for projecting charges onto the backside of sheet 46 in order to aid in inducing the transfer of charged toner images from the photoconductive surface 12 onto support material 46. The support material 46 is subsequently transported in the direction of arrow 58 for advancement to a fusing station EE. Fusing station EE includes a fuser assembly 60 for heating and permanently affixing the transferred toner image to sheet 46. Fuser assembly 60 preferably includes a heated fuser roller 62 and a support roller 64 forming a fusing nip for receiving and transporting a sheet of support material 46 therethrough.

After fusing, the advancing sheet of support material 46 is moved to a receiving tray 68 for subsequent removal of the finished copy by an operator. Invariably, after the support material 46 was separated from the photoconductive surface 12 of drum 10, some residual developing material remained adhered to drum 10. Thus, a final processing station, namely cleaning station FF, is provided for removing such residual toner particles from photoconductive surface 12 in preparation for subsequent charging and imaging on the surface 12 as described above. Cleaning station FF, for example, can include a rotatably mounted fibrous brush 70 for physical engagement with photoconductive surface 12 in order to remove toner particles therefrom.

The foregoing description is believed to be sufficient, for purposes of the present application for a patent, to illustrate the general operation of an electrostatographic reproduction or printer machine including the wrong-sign or polarity toner particles detection mode of the present invention.

Figure 2:
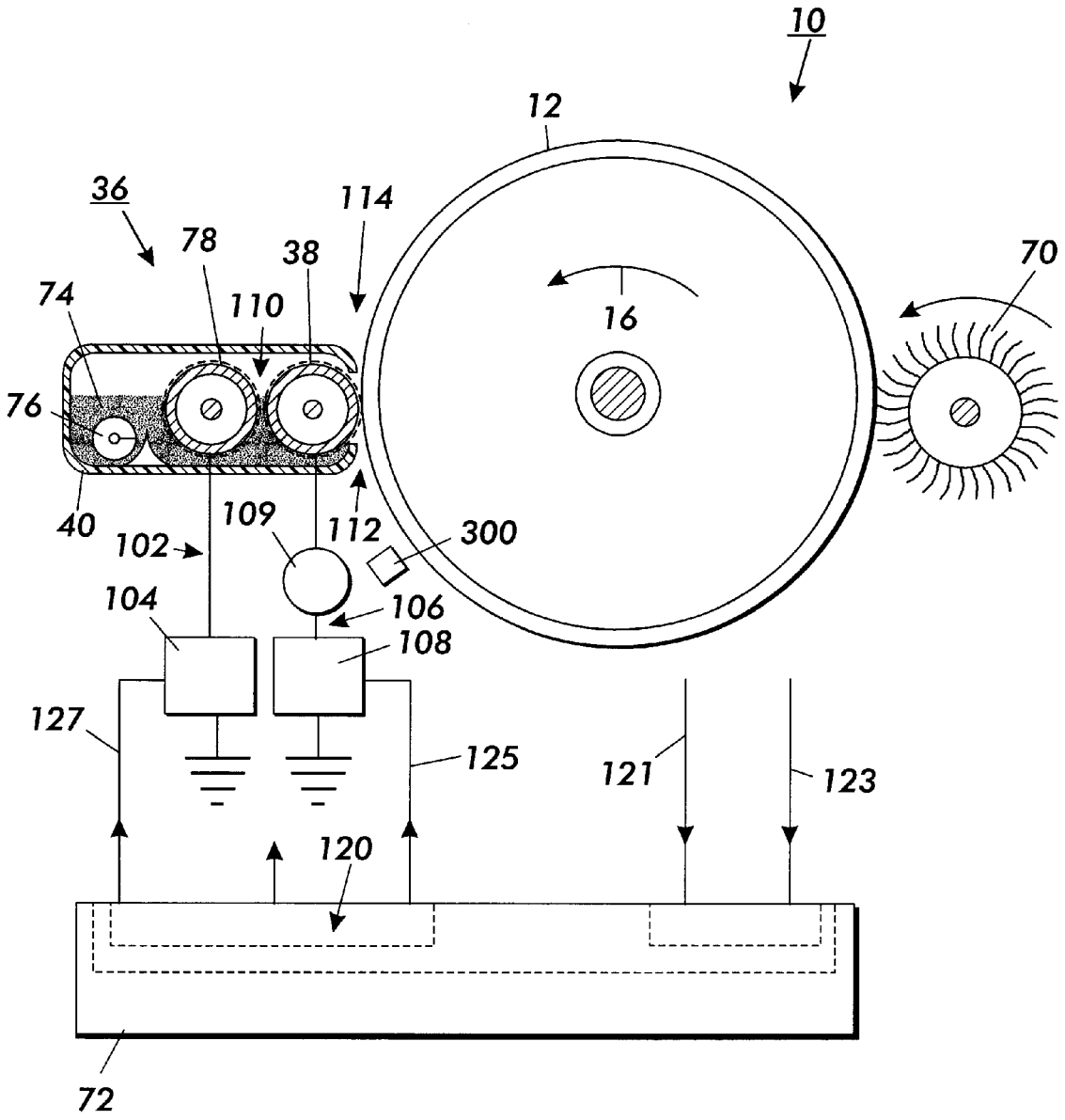
FIG. 2 is an enlarged detail of the biasing system and controller for the hybrid development system of FIG. 1.

Referring now to FIGS. 2, a fragmentary portion of the machine 8 is shown. The mechanism for producing wrong sign toner generally in a developer unit housing is ordinarily poorly understood.

During the initial transfer of toner from a magnetic brush or roll to a donor roll within the sump of the development housing, followed by a subsequent transfer of the toner by the donor roll to a photoreceptor. The donor roll potential is usually different from that of the magnetic roll so as to establish a driving electric field such that predominantly the toner of the correct sign or polarity is transferred to it from the magnetic roll. Then from the donor roller the toner is transferred or developed onto the photoreceptor in the image areas of the photoreceptor. However, not all of the toner is transferred to the image areas of the photoreceptor. As a result, a layer of predominantly correct sign continues to build up on the, donor roll until the electric potential at the surface of the donor roll roughly equals the magnetic roll potential At that point, further toner transfer from the magnetic roll to the donor roll stops because the driving electric field has been reduced to zero. If a section of the donor roll thereafter transfers toner thereon to the photoreceptor, then during its next pass through its nip with the magnetic roll, there will be an electric field differential there to cause toner to again transfer from the magnetic roll and replenish the donor roll in that particular section. At no time during a normal hybrid development process are there ordinarily opposite electric field differential conditions between the magnetic roll and donor roll, that are suitable to cause or encourage wrong-sign toner (i.e. non-correct sign toner) to transfer from the magnetic roll to the donor roll.

Unfortunately, in spite of this some quantities of wrong sign toners do manage to transfer from the magnetic roll to the donor roll and ultimately to the background areas of the photoreceptor causing unwanted toner deposition in these background or white areas.

This is because once such wrong sign toner is on the donor roll, it tends undesirably to transfer to the background areas of an image on the photoreceptor. Another problem with the accumulation of wrong-sign toner in a hybrid development housing is "snowplowing" which is associated particularly with wire-HSD systems. When "snowplowing" occurs, wrong-sign toner actually combines with correct-sign toner to form large, neutral toner agglomerates. Because such toner agglomerates are too massive to slide underneath the wires, as well as have too low a charge to be electrically pulled over the wires, these agglomerates tend to collect on and undesirably contaminate HSD wires. Other problems with wrong-sign toner accumulation in a hybrid development housing include toner emissions and insufficient roll cleaning. Toner emissions occur because wrong-sign toner is relatively low charged and, hence, harder to control.

The method and apparatus of the present invention for detecting wrong-sign toner and subsequently adjusting the process control or otherwise compensating or dealing with the problem is therefore particularly useful. The detection method includes a special mode or setup operation which includes the steps of changing relative electrical bias values between the magnetic roll 78 and the donor roll 38 within the housing 40 of the development unit from imaging bias values (VMR, VDR) to wrong-sign toner purging bias values (VMP, VDP) so as to cause predominantly the wrong-sign toner particles to transfer from the magnetic roll 78 to the donor roll 38. The step of changing relative electrical bias values for the magnetic roll 78 and for the donor roll 38 consists of changing the polarity and magnitude of imaging bias values (VMR, VDR) for the magnetic roll and for the donor roll respectively in order to obtain purging bias values (VMP, VDP) for such rolls, where "M" is for magnetic roll, and "D" is for donor roll. The method further includes the steps of producing an electrostatic field on the image bearing member 10 for causing wrong-sign toner particles to transfer from the donor roll 38 to the image bearing member 10, next the amount of toner on the image bearing member is measured by densitometer 300. During sensing, the image bearing member is illuminated with electromagnetic energy densitometer 300, generates proportional electrical signals in response to electromagnetic energy, reflected off of the substrate and toner on the image bearing member, that was received by the densitometer. In response to the signals, the amount of developed toner mass per unit of area for each of the toner can be calculated. The present invention employs optimized color densitometers (OCD), which measures material density located on a substrate by detecting and analyzing both specular and diffuse electromagnetic energy signal reflected off of the density of material located on the substrate as described in U.S. Pat. No. 5,162,874 which is hereby incorporated by reference. But most any type of densitometer would work suitably. At a predetermined level of developed toner on the image bearing member, the process control system can have an option elected to purge the developer housing of wrong-sign toner by continuing developing wrong sign toner to the image bearing member, an option to lower the toner concentration in the developer housing, request servicing by operator or any other option which would mitigate the excessive wrong sign toner problem, else it could elect to continue printing prints if the level is determined to be nominal Irrespective of what option is selected by the process control, a cleaning device 70 moves in contact with the image bearing member for removing all toner particles from the image bearing member.

As shown in FIG. 2, detection apparatus 100 includes first biasing means 102 including a first DC power supply 104 for biasing the magnetic roll 78 that is mounted within the housing 40 of the hybrid development unit 36. A second biasing means 106 including a second DC power supply 108 is similarly provided for biasing the donor roll 38. The second biasing means 106 also includes an AC power source 109 connected to said second biasing means for applying an AC bias to the donor roll As mounted within the housing 40 the donor roll forms a first toner transfer nip 110 with the magnetic roll 78, and a second toner transfer or development nip 112 with the image bearing member 10. As is well known in the case of hybrid development units, AC biased electrodes can be incorporated such as wires 114 are located within the development nip 112 for producing a toner cloud within the development nip 112. Similarly an AC Jumping type development system can be created by using substantially high AC values for AC source 109.

It should be noted that the embodiment described here utilizes an electrostatics configuration which develops right sign toner into the image areas where the right sign polarity is the opposite of the charging potential of device AA 26. However it should be appreciated that the present invention applies equally to system configurations where the relative image potentials and development housing biases are such that the right sign image toner is of the same polarity as the charging device. These are commonly known as "write black" systems. Similarly other non-electrophotographic systems can also be used such as ionographic or electron beam imaging techniques.

It is, therefore, apparent that there has been provided in accordance with the present invention, a method and apparatus for effectively and automatically detecting wrong sign toner from the development housing of a hybrid development unit of an electrophotographic reproduction machine that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. An electrophotographic reproduction machine, including:

an image bearing member;

means for forming electrostatic latent images having a first relative polarity on the image bearing member;

a development unit for applying to the latent images correct-sign toner particles having a second polarity relatively opposite to the first polarity in a first mode of operation; said development unit applying wrong sign toner of said first polarity to non image regions on the image bearing member during a second mode of operation;

a detecting apparatus adjacent the image bearing member for sensing an amount of toner particles developed into non-image regions a controller, responsive to said detecting apparatus, for enabling said first mode of operation if said amount of toner particles sensed is below predetermined amount or enabling said second mode of operation until said amount of toner particles sensed is below said predetermined amount.

2. The machine of claim 1, further including:

a first biasing means including a DC power supply for biasing a magnetic roll mounted within a housing;

a second biasing means includes a second DC power supply for biasing a donor roll mounted in the housing adjacent to said magnetic roll forming a toner transfer nip with the magnetic roll;

means for adjusting said first and second biasing means so that wrong sign toner of said first polarity are attracted to the donor roll from the magnetic roll;

means for generating an electrostatic field between the image bearing member and the donor roll to attract wrong sign toner to the image bearing member.

* * * * *